US008544869B2

(12) United States Patent
Lehner

(10) Patent No.: US 8,544,869 B2
(45) Date of Patent: Oct. 1, 2013

(54) TOURING BINDING

(75) Inventor: Edwin Lehner, Gilching (DE)

(73) Assignee: Salewa Sport AG, Herisau (CH)

( * ) Notice: Subject to any disclaimer, the term of this patent is extended or adjusted under 35 U.S.C. 154(b) by 101 days.

(21) Appl. No.: 13/150,517

(22) Filed: Jun. 1, 2011

(65) Prior Publication Data

US 2011/0298196 A1 Dec. 8, 2011

(30) Foreign Application Priority Data

Jun. 2, 2010 (DE) ..... 10 2010 029 647

(51) Int. Cl.
*A63C 9/00* (2012.01)

(52) U.S. Cl.
USPC ..... 280/611; 280/614

(58) Field of Classification Search
USPC ..... 280/601, 607, 609, 11, 11.3, 11.31, 280/11.33, 11.14, 613–614, 616–617, 623–626, 280/633–634
See application file for complete search history.

(56) References Cited

U.S. PATENT DOCUMENTS 4,348,036 A * 9/1982 Settembre ..... 280/615

FOREIGN PATENT DOCUMENTS

DE 27 06 111 A1 8/1978
DE 32 27 237 C1 1/1984
WO 2009/121187 A1 10/2009

OTHER PUBLICATIONS

European Search Report cited in 11168430.4-2318 dated Sep. 21, 2011, 6 pgs.

* cited by examiner

*Primary Examiner* — John Walters
*Assistant Examiner* — James Triggs
(74) *Attorney, Agent, or Firm* — Rothwell, Figg, Ermst & Manbeck, P.C.

(57) ABSTRACT

The present invention relates to a touring binding comprising two bearing portions arranged on different sides of a longitudinal axis, which bearing portions, in a walking position of the touring binding, are designed to engage with opposing lateral counter-bearing portions of a boot, in order to hold the boot on the touring binding pivotably about a transverse axis extending transversely of the longitudinal axis, characterized by a longitudinal positioning portion separate from the bearing portion, on which positioning portion the boot may be supported in an insertion position in such a manner that the counter-bearing portions are positioned, with regard to their location along the longitudinal axis, in a ready-to-engage position relative to the bearing elements.

9 Claims, 10 Drawing Sheets

Figure 1A:
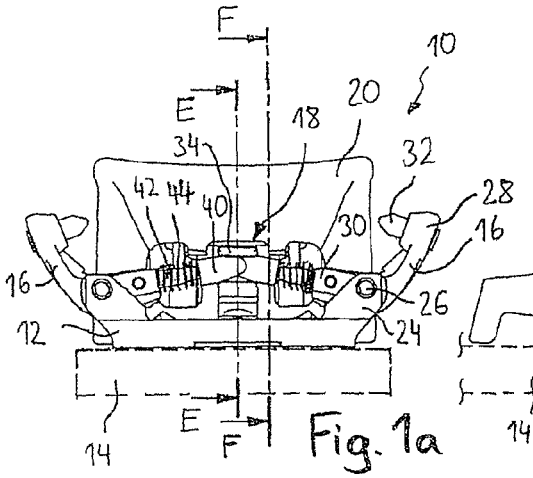

210
232
216
217
220a
236
250
212

232
216
220a
220b 216
232
221b
220b
217
236
250
212
216
220a
217

216
232
221b
212
220b
217
218
210
250
236
221a
220a

TOURING BINDING

The present invention relates to a touring binding comprising two bearing portions arranged on different sides of a longitudinal axis, which bearing portions, in a walking position of the touring binding, are designed to engage with opposing lateral counter-bearing portions of a boot, in order to hold the boot on the touring binding pivotably about a transverse axis extending transversely of the longitudinal axis.

Touring bindings of this kind are in particular fitted to touring skis and used in conjunction with an automatic heel mechanism, such that, when climbing, the touring binding may be set to a walking position, in which the automatic heel mechanism releases the heel of the boot and the boot can pivot freely about the bearing portions and, when skiing downhill, the touring binding may be set to a downhill position, in which the automatic heel mechanism reliably holds the heel of the boot in fixed manner on the ski. The touring bindings addressed in the context of the present disclosure may, however, equally well be used on splitboards (snowboards which can be divided lengthwise, the halves of which may be used like touring skis when climbing) or also on snow shoes.

One example of a touring binding of the initially stated type known from the prior art is disclosed in EP 0 199 098 A2 and comprises two lateral, inward-pointing pins as bearing portions, which engage in corresponding lateral holes of a front portion of a touring ski boot. The pins are fastened to distal ends of respective clamping brackets, wherein the clamping brackets are pivotably mounted on the touring binding for opening and closing the touring binding and may be moved between an open position and a closed position by means of a binding actuation arrangement. When inserting the boot into the known touring binding, the ski boot must be positioned such that its lateral bearing holes are located directly opposite the bearing pins of the touring binding, such that the bearing pins can snap into the bearing openings when the binding is closed. During practical use on a mountain, correct positioning of the ski boot may often be difficult, especially for inexperienced users.

In order to make it easier to identify the correct insertion position for the ski boot, EP 1 559 457 A1 proposes an insertion aid formed on the ski boot in the area of the bearing openings, which, when the ski boot is pushed in in the forwards direction, guides the pins to the correct position opposite the bearing openings. This insertion aid can greatly facilitate insertion of the boot into the touring binding, but the reliability of correct positioning of the ski boot by the insertion aid is limited by the fact that an excessively projecting design of the insertion aid on the ski boot impairs ease of use of the ski boot when travelling without skis. In particular, if rocky ground has to be crossed without skis, excessively prominent insertion aids at the lateral bearing openings may entail the risk of the user snagging the ski boot on a projecting rock.

Once the boot has been inserted and the binding closed, known touring bindings may be set to a walking position, in which an automatic heel mechanism releases the heel of the boot, such that the boot is pivotable about the transverse axis, or alternatively to a downhill position, in which the automatic heel mechanism holds the heel of the boot in fixed manner, such that the boot is held overall in fixed manner close to the surface of the ski. In order to be able to ensure safety release of the binding in the event of a fall, i.e. release of the boot from the binding when a predetermined release force is exceeded, according to EP 0 199 098 A2 for example the clamping brackets holding the bearing pins are pretensioned by means of springs into the position of engagement with the bearing holes. If a force acts on the boot in a lateral direction (transversely of the ski axis, or torque about an axis of rotation vertical to the plane of the ski), the clamping brackets are pivoted against the force of the springs and the bearing pins are pushed laterally out of the bearing openings such that the ski can become detached from the boot.

Such safety release is unwanted in particular in the case of more sporting use of touring skis, for instance in competitive touring skiing. The sometimes elevated forces which act in a lateral direction on the binding when climbing may then sometimes exceed the release force, so releasing the touring binding and causing the user to lose the ski. In order to prevent this, known touring bindings, for instance according to EP 0 199 098 A2, comprise an additional locking mechanism which, in walking position, locks the clamping brackets and, in downhill position, unlocks them to enable safety release. However, such a locking means is not only associated with the disadvantage of additional design complexity and elevated weight, but often cannot sufficiently safely ensure reliable locking. In addition, locking and unlocking entail particular operating effort.

Against this background, it is an object of the present invention to provide a touring binding which exhibits improved functionality and operability to avoid the above-stated disadvantages of the prior art, and which in particular facilitates correct positioning of the boot during insertion and/or is capable of preventing unintentional release of the binding.

According to a first aspect of the invention, the stated object of the invention is achieved by a touring binding comprising two bearing portions arranged on different sides of a longitudinal axis, which bearing portions, in a walking position of the touring binding, are designed to engage with opposing lateral counter-bearing portions of a boot, in order to hold the boot on the touring binding pivotably about a transverse axis extending transversely of the longitudinal axis, characterised by a longitudinal positioning portion separate from the bearing portions, on which positioning portion the boot may be supported in an insertion position in such a manner that the counter-bearing portions are positioned, with regard to their location along the longitudinal axis, in a ready-to-engage position relative to the bearing elements.

According to the first aspect of the invention, a longitudinal positioning portion is thus provided on the touring binding against which the boot can rest in the correct insertion position. On inserting the boot into the binding the user thus only needs to rest the boot on the longitudinal positioning portion and may in this way easily find the correct position for closing the binding. Even inexperienced users may thus operate the binding simply and intuitively and the boot can be successfully inserted into the binding even under difficult conditions of use.

Positioning of the boot by the longitudinal positioning portion here proceeds with regard to the location of the boot along the longitudinal axis of the touring binding. The longitudinal axis of the touring binding is defined by the direction of travel of the operatively fitted touring binding, which is defined by attachment means, for example fastening holes of the touring binding. The user can guide the ski boot, in particular by forward movement, along the longitudinal axis to the longitudinal positioning portion and rest it there until the counter-bearing portions are positioned in a ready-to-engage position. Positioning in the vertical direction (vertical to the plane of the ski or snowboard etc.) may advantageously be achieved by a further supporting portion of the touring binding.

The longitudinal positioning portion particularly preferably comprises a limit stop, with which a front portion of the boot comes into contact in the insertion position. The longitudinal positioning portion may then be of a simple design, in particular taking the form of a limit stop surface, limit stop line or limit stop point. Front portions of the boot which may be considered are any portions of the boot which are oriented in the forwards direction or obliquely forwards direction, in particular surface portions, the surface normals of which form an angle of between 0 and 90° with the forwards direction. The longitudinal positioning portion will particularly preferably be a front limit stop which engages with a front portion of the boot arranged in the sole region of the boot in front of the counter-bearing portions.

A preferred embodiment of the invention provides that the touring binding is adjustable between an open position, in which the bearing portions and the counter-bearing portions are out of engagement, and the walking position, in which the bearing portions and the counter-bearing portions are engaged with one another, wherein, in the open position, the longitudinal positioning portion is placed into a first position for supporting the boot in the insertion position and, in the walking position, is placed or placeable into a second position, in which it enables pivoting of the boot about the transverse axis for walking. In such an embodiment, the shape and size of the longitudinal positioning portion is not limited by the freedom of movement of the ski boot which is to be ensured. A relatively large limit stop which is readily found on insertion of the boot may for example accordingly be provided which, in the walking position, may then be flipped out of the way in order to allow the boot to pivot. The stated embodiment thus increases freedom of design for the longitudinal positioning portion.

The adjustment mentioned in the previously described embodiment of the longitudinal positioning portion from the first position into the second position may be effected by manual actuation by the user, such that a simple structure may be selected for the longitudinal positioning portion. It may, however, particularly conveniently be provided that, on adjustment of the touring binding from the open position into the walking position, the longitudinal positioning portion is adjusted from the first position into the second position. In the open position, the longitudinal positioning portion may thus for example provide the desired limit stop in the form of a limit stop element, wherein the movement or adjustment of the touring binding which in any event takes place for closure of the binding and changeover to the walking position is simultaneously used to move or adjust the limit stop element into the second position, in which the limit stop element does not prevent the pivoting movement of the boot.

The longitudinal positioning portion may furthermore also be adjusted from the first to the second position by a pivoting movement of the boot about the axis of the bearing portions, such that, in the walking position, the longitudinal positioning portion is displaced from the first position into the second position during the user's first step.

According to a per se known principle of operation, the touring binding may be adjusted by the user by means of a binding actuation arrangement from the open position into the walking position, wherein in so doing the bearing portions are moved towards one another and then come into engagement with the counter-bearing portions of the boot. According to a further exemplary embodiment of the invention, a touring binding comprising such a binding actuation arrangement is provided with a coupling, which transmits an adjusting movement of the binding actuation arrangement to the longitudinal positioning portion. Actuation of the binding actuation arrangement may thus be coupled with an adjusting movement of the longitudinal positioning portion, such that the longitudinal positioning portion may move between the first and second positions without major operating effort on the part of the user.

A longitudinal positioning portion adjustable between a first and a second position may furthermore preferably be pretensioned towards the second position and be lockable in the first position. In order to adjust the longitudinal positioning portion into the second position, it may then be sufficient for locking of the first position to be released, such that the actual movement of the longitudinal positioning portion to the second position and retention of the longitudinal positioning portion in the second position may be achieved by the force of a resilient means. In this manner, savings may be made in terms of technical effort for guiding the movement of the longitudinal positioning portion over the adjustment path.

A further preferred embodiment of the invention provides that the coupling comprises a control lever which is coupled with the binding actuation arrangement, wherein the control lever comprises a supporting portion on which the longitudinal positioning portion rests in the first position in order to prevent the longitudinal positioning portion from moving towards the second position, and wherein, in a closed state of the touring binding, the control lever is arranged such that the supporting portion permits movement into the second position. Such a control lever may provide a coupling of simple design between the binding actuation arrangement and longitudinal positioning portion. The stated closed position of the touring binding may be an above-mentioned walking position or alternatively a downhill position of the touring binding, in which a heel portion of the boot is fixed to the ski. If, in the closed position, the supporting portion of the control lever allows the longitudinal positioning portion to move into the second position, this need not necessarily mean that said movement actually occurs. For example, in a downhill position (likewise a closed position), the longitudinal positioning portion could be supported in its first position by a further locking element of the touring binding instead of by the supporting portion of the control lever.

According to a second aspect of the invention, the above-stated object of the invention is achieved by a touring binding comprising two bearing portions arranged on different sides of a longitudinal axis, which bearing portions, in a closed position of the touring binding, are designed to engage with opposing lateral counter-bearing portions of a boot, in order to hold the boot on the binding arrangement pivotably about a transverse axis extending transversely of the longitudinal axis, and a lateral support arrangement separate from the bearing portions, on which lateral support arrangement a front portion of the boot may be supported in the closed position of the touring binding to block movement of the boot transversely of the longitudinal direction.

One important feature of the second aspect of the invention is the provision of a lateral support arrangement for blocking lateral movement of the boot in the closed position of the touring binding, whereby it is ensured that a laterally acting force exerted by the boot on the touring binding during use of the touring binding is not or is at most only partially introduced into the bearing portions, but may instead be completely or at least partially absorbed by the lateral support arrangement. Because the lateral support arrangement is provided separately from the bearing portions, it is possible, in particular in touring bindings, in which the bearing portions may be moved in the lateral direction between the open and closed position, to use a ski-mounted lateral support element which is firmly connected to a touring binding base member which is to be fastened to the ski, such that the forces exerted by the boot in the lateral direction on the touring binding may reliably be absorbed by the touring binding. Lateral release of the touring binding may then be effected only by release of the automatic heel mechanism, such that the desired release characteristics, in particular the Mz release torque, may reliably be controlled by appropriate settings of the automatic heel mechanism.

A structurally simple embodiment, which simultaneously permits very reliable absorption of the forces exerted by the boot in the lateral direction on the binding, uses a lateral support arrangement which is fastened on a ski-mounted touring binding base member or is designed to be fastened to the ski (or to the board, snowshoe etc.). If the lateral support arrangement comprises a left-hand lateral support portion for supporting a left-hand outer front lateral portion of a boot and a right-hand lateral support portion for supporting a right-hand outer front lateral portion of a boot, the lateral support arrangement may interact reliably with all boots of the correct size for the bearing portions of the touring binding and provide support in both a left-hand and a right-hand direction.

Reliable and material-protecting support is ensured if the lateral support arrangement comprises at least one limit stop surface which is adapted at least in portions to an outer contour of a boot. The forces acting in a lateral direction may then be introduced into the lateral support arrangement over a relatively large area, such that wear of the touring binding and of the boot used may be reduced.

A further embodiment of the invention proposes that the lateral support arrangement be arranged adjacent the bearing portions of the touring binding. In this manner, it is possible to achieve compact construction of the touring binding and the introduction of lateral forces into the bearing portions may be reduced to a very great extent.

In order to create a particularly compact structure, it may be feasible for at least one of the bearing portions to be arranged on a pivotable clamping bracket, wherein the at least one clamping bracket comprises a recess and wherein the lateral support arrangement is at least in part arranged in the recess. To open and close the touring binding, the at least one clamping bracket may then move relative to the lateral support arrangement, wherein both components may simultaneously be arranged very close together and substantially even without any increase in structural space.

A touring binding of the invention particularly preferably realises the features of the first aspect of the invention and the features of the second aspect of the invention, in particular in each case according to the above-stated further developments thereof. Combining the two aspects in one touring binding gives rise, in addition to the advantages listed above in each case, to the further effect that the lateral support arrangement and the longitudinal positioning arrangement provide the user with the impression of comprehensive, all-round positioning and guidance of the boot on the touring binding for the purpose of inserting the boot. On inserting the boot, the user may accordingly position the boot in the longitudinal direction thanks to the longitudinal positioning arrangement while simultaneously obtaining guidance from the lateral support arrangement in order to identify the correct position in the lateral direction.

Particularly advantageous savings of structural space and design complexity may be achieved if the longitudinal positioning arrangement comprises a limit stop, against which a front portion of the boot comes to a rest in the insertion position, wherein the lateral support arrangement comprises at least one lateral support portion for supporting an outer front lateral portion of the boot, wherein the longitudinal positioning arrangement and the lateral support arrangement are formed by the same limit stop arrangement, and wherein the front limit stop of the longitudinal positioning arrangement and the lateral support portion are constructed adjacent one another on a common limit stop element or are constructed as the same limit stop on a combination limit stop element. Such variants of the invention are capable of realising both aspects, namely longitudinal positioning and lateral support, thanks to a common limit stop element or combination limit stop element, such that the design complexity and weight of the touring binding may be reduced.

Figure 1B:
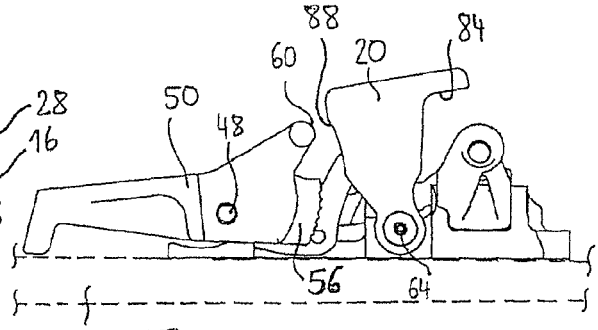
Figure 1C:
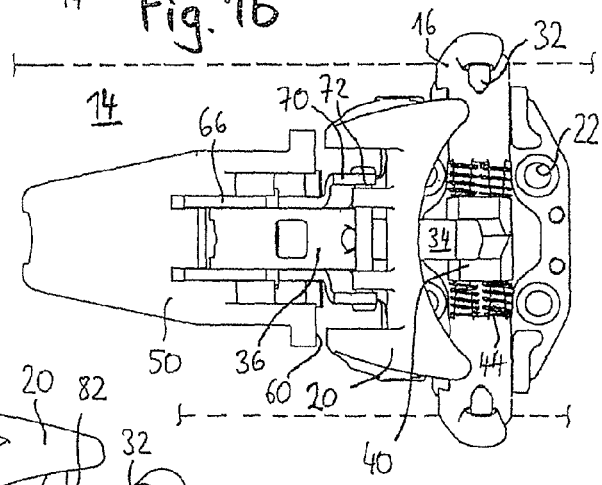

The invention is explained in greater detail below on the basis of preferred exemplary embodiments with reference to the attached drawings, in which:

FIG. 1*a* is a front view of a touring binding according to a first exemplary embodiment of the invention in the open position;

FIG. 1*b* is a side view of the touring binding shown in FIG. 1*a* in a view from the left;

FIG. 1*c* is a plan view of the touring binding shown in FIG. 1*a;*

Figure 1D:
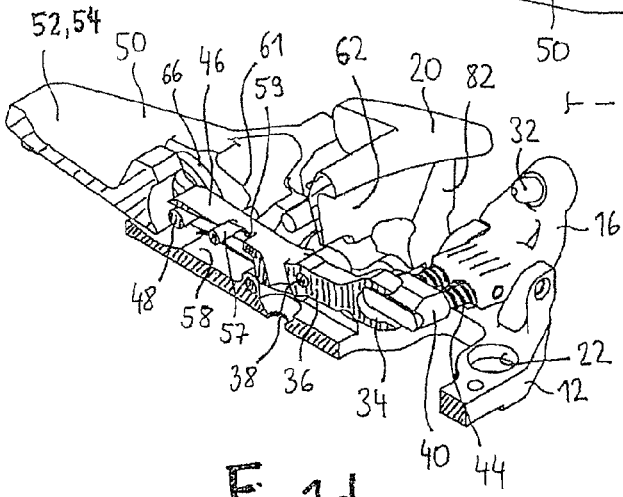

FIG. 1*d* is a sectional, perspective partial view along section line E-E in FIG. 1*a* of the touring binding shown in FIG. 1*a;*

Figure 1E:
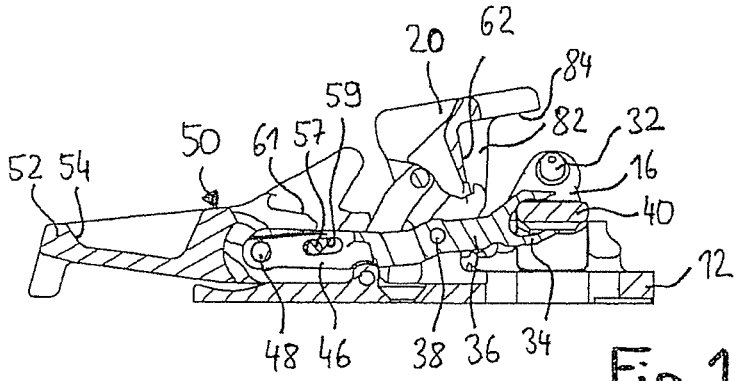

FIG. 1*e* is a longitudinal sectional view of the touring binding shown in FIG. 1*a* along a section line E-E in FIG. 1*a;*

Figure 1F:
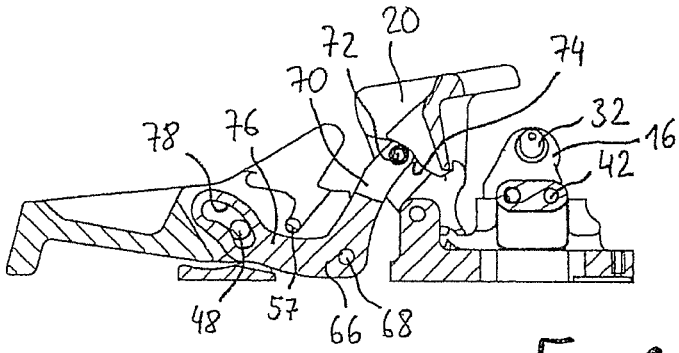

FIG. 1*f* is a longitudinal sectional view of the touring binding shown in FIG. 1*a* along a section line F-F in FIG. 1*a;*

Figure 1G:
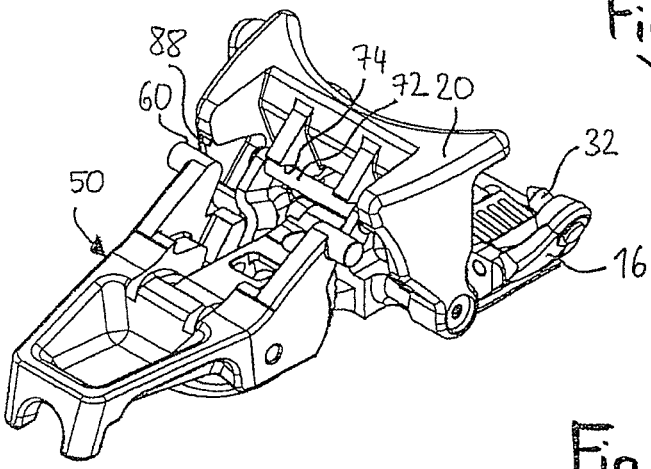
Figure 4A:
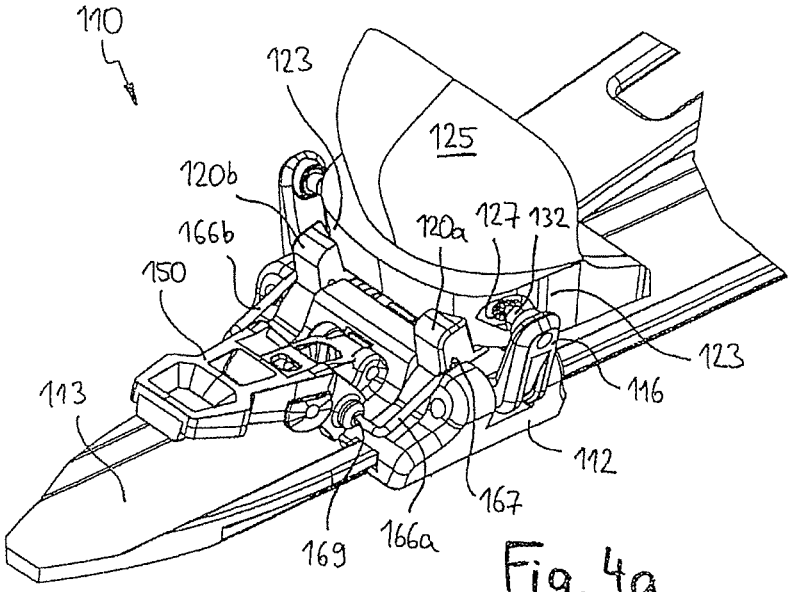
Figure 4B:
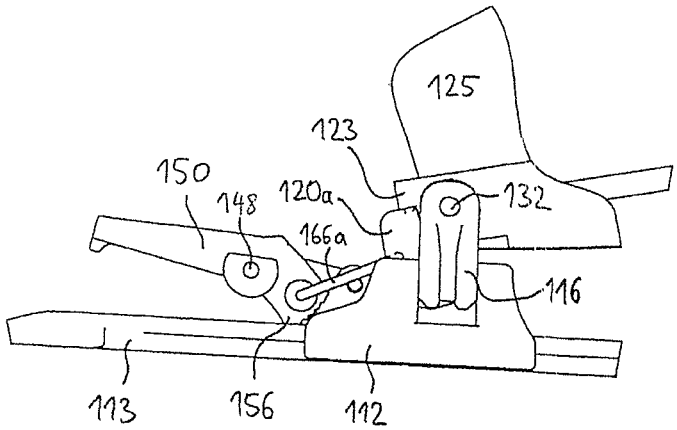

FIG. 1*g* is a perspective view of the touring binding shown in FIG. 1*a* viewed obliquely from the front left;

FIGS. 2*a* to 2*g* are views of the touring binding of the first exemplary embodiment corresponding to the views of FIGS. 1*a* to 1*g*, but in a first closed position;

FIGS. 3*a* to 3*g* are views of the touring binding of the first exemplary embodiment corresponding to the views according to FIGS. 1*a* to 1*g*, but in a second closed position;

FIG. 4*a* is a perspective view from the front left of a touring binding according to a second exemplary embodiment of the invention in an open position;

FIG. 4*b* is a side view from the left of the touring binding shown in FIG. 4*a;*

Figure 5A:
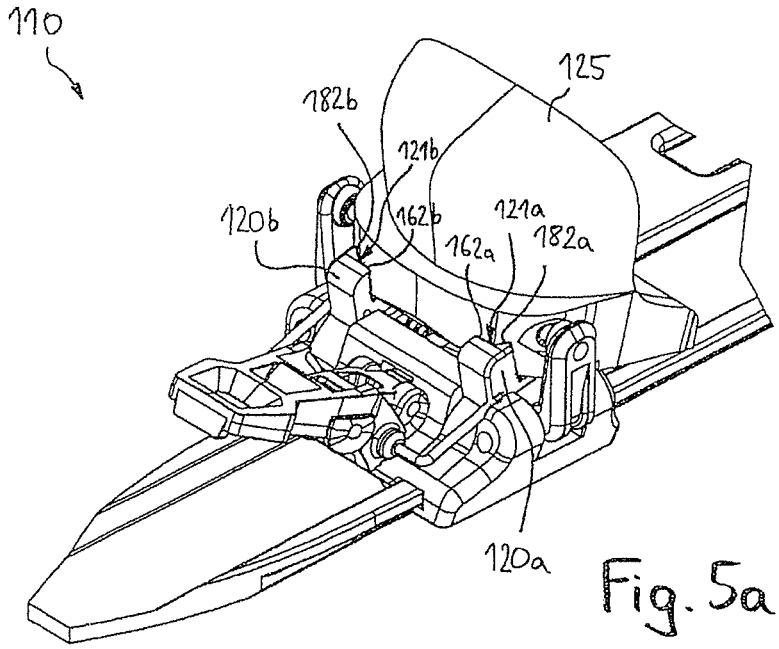
Figure 5B:
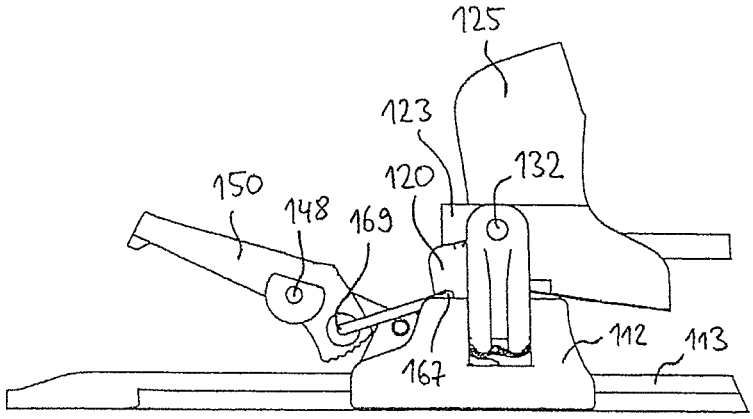
Figure 6A:
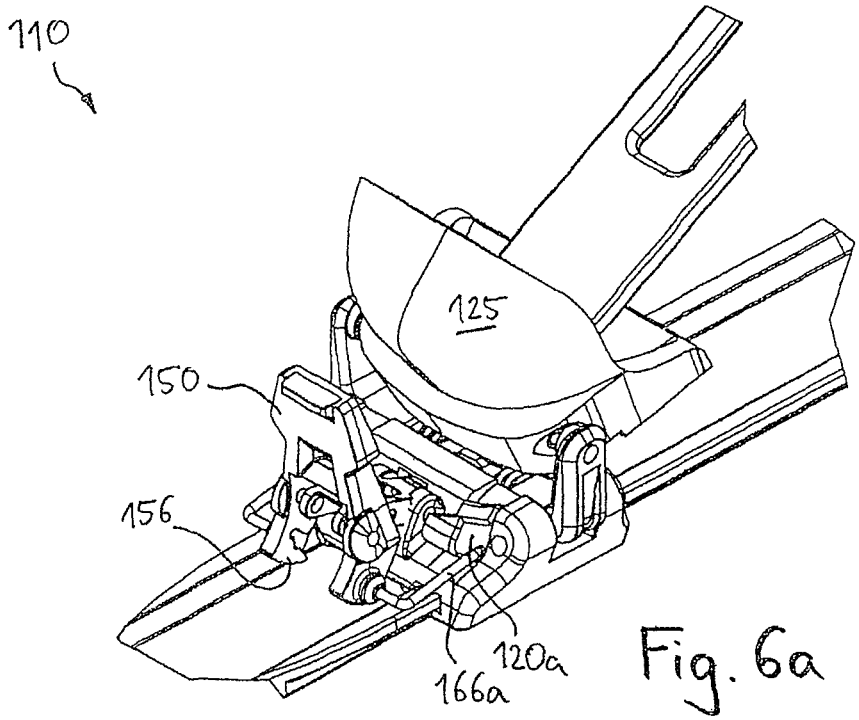
Figure 6B:
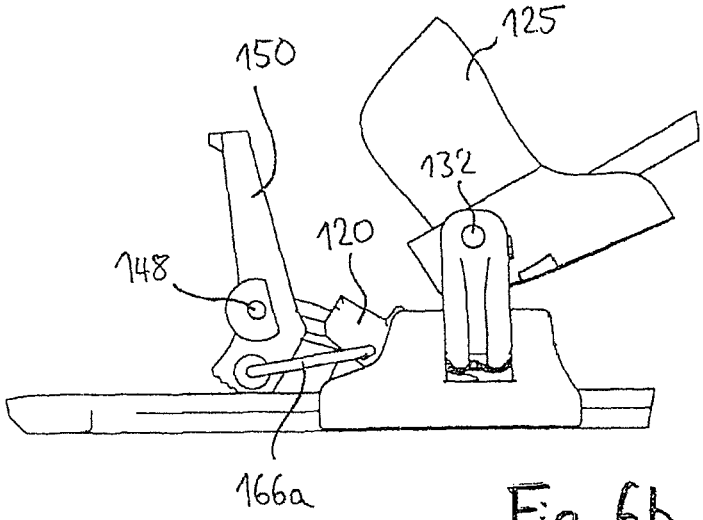
Figures 7A, 7B, 7C, 7D:
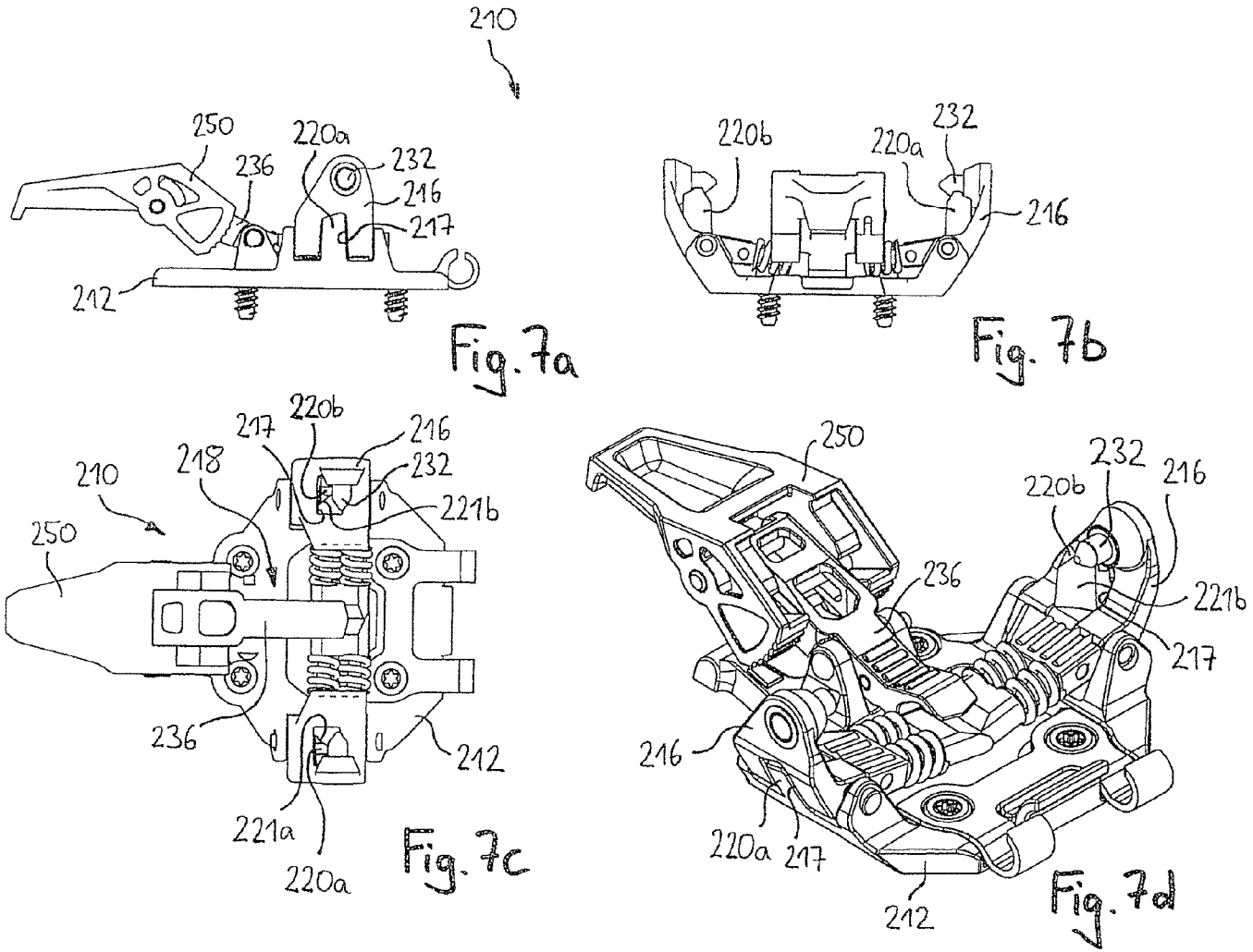

FIGS. 5*a* and 5*b* are views of the touring binding of the second exemplary embodiment corresponding to the views of FIGS. 4*a* and 4*b*, but in a first closed position of the touring binding;

FIGS. 6*a* and 6*b* are views of the touring binding of the second exemplary embodiment corresponding to the views of FIGS. 4*a* and 4*b*, but in a second closed position of the touring binding;

FIG. 7*a* is a side view from the left of a touring binding of a third exemplary embodiment of the invention in a first closed position;

FIG. 7*b* is a front view of the touring binding shown in FIG. 7*a;*

FIG. 7*c* is a plan view of the touring binding shown in FIG. 7*a* and

FIG. 7*d* is a perspective view from the left rear of the touring binding shown in FIG. 7*a*.

In the present disclosure, directional and spatial indications such as "top", "bottom", "left", "right", "front", "rear", "vertical", "horizontal" or the like relate to an operatively fitted state of the touring bindings, in which the latter are for example fastened to a touring ski and the observer understanding these terms is standing on horizontal ground and looking forwards in the direction of travel of the touring skis. An axis extending in the X direction then extends parallel to the direction of view and parallel to the longitudinal axis of the touring ski, the Y direction extends orthogonally to the X direction and parallel to the horizontal ground and a Z direction extends orthogonally to the X direction and to the Y direction vertically to the horizontal ground.

A first exemplary embodiment of the invention is described below with reference to FIGS. 1*a* to 3*g*.

The touring binding 10 of the first exemplary embodiment comprises a base plate 12 for fastening the touring binding 10 to a ski (indicated with reference numeral 14 in FIGS. 1*a*, 1*b* and 1*c*), clamping brackets 16 for holding and pivotably mounting a touring ski boot, a binding actuation mechanism 18 for actuating the touring binding 10, in particular the clamping brackets 16, and a limit stop element 20 as a positioning aid for the ski boot on insertion into the touring binding 10.

For fastening to the ski 14, the base plate 12 may comprise a plurality of fastening holes 22, into which may be inserted fastening screws to be screwed into the ski 14. Constructed in one piece on the base plate 12 or fastened thereto are left-hand and right-hand bearing portions 24, which hold the clamping brackets 16 in each case pivotably about a pivot pin 26 extending in the X direction.

Each clamping bracket 16 comprises a first arm 28 which extends substantially upwards from the pivot pin 26 and a second arm 30 which extends substantially towards the middle of the ski from the pivot pin 26. A journal 32 is in each case arranged at an upper distal end of the first arm 28, the tip of which journal points substantially inwards, i.e. towards the middle of the ski. The journal 32 is designed in a manner known per se to engage in a lateral bearing opening of a ski boot, in order, in a walking position of the touring binding 10, to hold the ski boot on the touring binding 10 pivotably about a transverse axis Q extending in the Y direction.

The distal ends of the second arms 30 of the clamping brackets 16 facing towards the middle of the ski are jointly held by a fork-like end portion 34 of an actuating lever 36 of the binding actuation mechanism 18, which actuating lever is mounted pivotably about a pivot pin 38 extending in the Y direction on a bearing portion of the base plate 12. Specifically, in the exemplary embodiment, the fork-like end portion 34 in each case holds an end cap 40 of each clamping bracket 16, which end cap is in each case displaceably pushed onto pins 42 projecting from the second arm 30 of each clamping bracket 16, such that each of the end caps 40 can be displaced along the pins 42 in the Y direction. By means of compression springs 44 wound around the pins 42, the end caps 40 are pretensioned towards the middle of the ski and thus towards one another and are pressed into contact with one another. In a manner known per se, a pivoting movement of the actuating lever 36 about the pivot pin 38 gives rise to a vertical movement of the two end caps 40 and thus to a pivoting movement of the clamping bracket 16 about the pivot pins 26.

At a distal end of a second arm 46 remote from the fork-like end portion 34 of the actuating lever 36, an operating lever 50 is held pivotably on a pivot pin 48 extending in the Y direction. The operating lever 50 comprises an operating portion 52 which is actuatable manually or by means of a ski pole (for example by means of a ski pole receiving hollow 54) in order to move the binding between the open position and the closed position. The operating lever 50 furthermore comprises a locking portion 56 remote from the operating portion 52, which locking portion is designed, in the event of a pivoting movement of the operating lever 50, to come into contact with a cam face 58 on the top of the base plate 12 or of the ski 14, in order to impart an upwards or downwards movement of the second arm 46 of the actuating lever 36 corresponding to the surface contour of the cam face 58 and thus to control the pivoting movement of the actuating lever 36 and thus also the pivoting movement of the clamping brackets 16.

The operating lever 50 is connected to the actuating lever 36 not only via the pivot pin 48, but furthermore via a slide guide composed of a free pin 57 extending in the Y direction, which pin is guided in a slide 59 in the actuating lever 36 in such a manner that it may be displaced substantially in the X direction along the actuating lever 36. A tension spring, not shown in the drawings, is tensioned between the pin 57 and the pivot pin 48 such that the pin 57 is pretensioned towards the pivot pin 48. The pin 57 rests on a cam face 61 of the operating lever 50 and is pressed against the cam face 61 by the tension spring tensioned between the pivot pin 48 and pin 57. The cam face 61 is shaped (for example with a vertex) such that the operating lever 50 has two stable states with regard to a pivoting movement relative to the actuating lever 36, namely the state shown in FIGS. 1*a* to 1*g* in the open position, in which the operating lever 50 is flipped down, and the state shown in FIGS. 3*a* to 3*g* of the second closed position, in which the operating lever 50 is flipped up.

The operating lever 50 furthermore comprises a supporting portion 60 for the limit stop element 20, on which the limit stop element 20 may rest in a first closed position which is to be described below.

The limit stop element 20 comprises a rear contact surface 62 which is designed to come into contact with a front sole portion of an appropriate touring ski boot. The limit stop element 20 is mounted pivotably about a pivot pin 64 extending in the Y direction on a bearing portion of the base plate 12. By means of a folding mechanism which is to be described below it is possible to ensure that, in the open position, the contact surface 62 is arranged in a position such that a touring ski boot with its front sole portion resting thereagainst is positioned ready for insertion, i.e. in particular in such a way that, with regard to displacement of the touring ski boot in the X direction, the lateral bearing openings of the touring ski boot are arranged at the position of the journals 32.

The pivoting movement of the limit stop element 20 is controlled by a folding mechanism which comprises a control lever 66 which is mounted pivotably about a pivot pin 68 extending in the Y direction on a bearing portion of the base plate 12. A first arm 70 of the control lever 66 comprises at the distal end thereof a supporting portion 72, which is designed to come into contact with a counter-supporting portion 74 of the limit stop element 20, in order to limit a forward pivoting movement of the limit stop element 20 (anticlockwise in FIGS. 1*b*, 1*e* and 1*f*).

A second arm 76 of the control lever 66 is coupled with the operating lever 50 so as to transmit movement and force. In the exemplary embodiment, a distal end of the second arm 76 comprises a slide 78, in which the pivot pin 48 of the operating lever 50 engages such that the pivot pin 48 is guided in the slide 78.

As may be seen in FIGS. 1*a* to 1*g* of the first exemplary embodiment, the limit stop element 20 may, in addition to the rear contact surface 62, comprise a lateral contact surface 82 on each side and/or an upper contact surface 84. The lateral contact surfaces 82 are designed to come into contact with lateral front portions of a sole portion of an appropriate touring ski boot, while the upper contact surface 84 may be designed to extend from above over a front sole portion projecting forwards in tongue-like manner in a manner known per se in the case of an appropriate touring ski boot.

In the first exemplary embodiment, the rear contact surface 62, the lateral contact surfaces 82 and the upper contact surface 84 take the form of integral portions of the same limit stop element 20 and merge into one another. The entire front sole portion of the touring ski boot may thus be form-fittingly enclosed by the limit stop element 20 not only in the X direction but also in the Y direction and the Z direction, so permitting intuitive positioning of the ski boot on insertion and reliable retention in the ready-for-insertion position. The limit stop element 20 may be manufactured inexpensively from a single casting, in particular a plastics injection moulding.

The mode of operation of the touring binding 10 of the first exemplary embodiment will now be explained in greater detail with reference to FIGS. 1*a* to 3*g*.

FIGS. 1*a* to 1*g* show the touring binding 10 in the open position, in which the clamping brackets are pivoted apart in such a manner that a ski boot may be inserted between the journals 32 or withdrawn from engagement. In the open position, the end caps 40 are located above a horizontal connecting line between the pivot pins 26 of the clamping brackets 16, such that the compression springs 44 transmit a force in the opening direction to the clamping brackets 16 (torque about the pivot pins 26 enlarging the distance between the journals 32). The second arm 46 of the actuating lever 36 is as close as possible to the ski 14 and the operating lever 50 rests extended on the top of the ski 14 or on the cam face 58.

The second arm 46, pivoted downwards in the opening direction, of the actuating lever 36 also holds the second arm 76 of the control lever 66 in a lower position via the pivot pin 48, such that the opposing first arm 70 of the control lever 66 and thus the supporting portion 72 of the control lever 66 is pivoted upwards and rests against the counter-supporting portion 74 of the limit stop element 20. The limit stop element 20 thus cannot flip forwards in the open position. The limit stop element 20 is preferably pretensioned forwards (i.e. anticlockwise in FIGS. 1*b*, 1*e* and 1*f*), for example by means of a spiral spring wound around the pivot pin 64 of the limit stop element 20, such that it rests under pretension against the supporting portion 72 of the control lever 66.

In the open position, an appropriate touring ski boot may be introduced from behind into the limit stop element 20 until a front sole portion of the boot makes contact with the rear contact surface 62, front lateral sole portions of the boot come into contact with the lateral contact surfaces 82 and the upper contact surface 84 extends over the front sole portion of the boot. The touring ski boot is then supported in an insertion position, wherein the rear contact surface 62 acts as a longitudinal positioning portion. In the insertion position, the bearing openings of the ski boot are positioned, with regard to their location along the X direction (longitudinal axis of the touring binding), in a ready-to-engage position relative to the journals 32. This means here that the journals 32 are located directly opposite the bearing openings of the ski boot, such that on subsequent closure of the touring binding 10, the journals 32 may slip straightforwardly into the bearing openings of the ski boot and engage therein. The rear contact surface 62 thus forms a front limit stop, with which a front portion of the boot comes into contact in the insertion position, in order to locate the boot in a ready-to-engage position.

In the insertion position, a vertical position of the ski boot is defined not only by the upper contact surface 84 of the limit stop element 20, but instead furthermore by a lower middle sole portion of the ski boot resting on top of the fork-like end portion 34 of the actuating lever 36 or on the end caps 40. In order to adjust the touring binding 10 from the open position into a first closed position shown in FIGS. 2*a* to 2*g*, the user may, by exerting pressure downwards in the Z direction on the fork-like end portion 34 or the end caps 40, pivot the actuating lever 36 clockwise in FIGS. 1*b*, 1*e* and 1*f* until the actuating lever 36 reaches the position shown in FIGS. 2*a* to 2*g*.

Figure 2A:
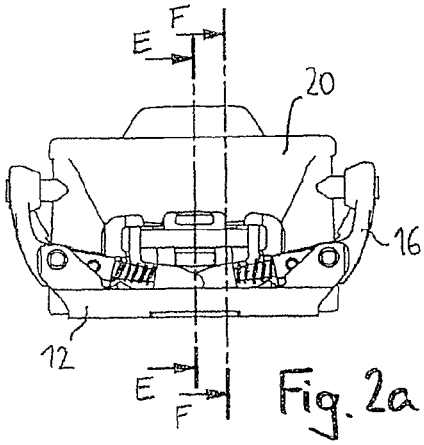

As may be seen particularly clearly in FIG. 2*a*, in the first closed position the end caps 40 are located below a horizontal connecting line between the pivot pins 26 of the clamping brackets 16, such that the force of the compression springs 44 presses the end caps 40 further towards the ski. On moving from the open position into the first closed position, the clamping brackets 16 and the binding actuation mechanism 18 thus pass through a dead centre, such that the user need only apply compressive force to the fork-like end portion 34 and the end caps 40 until the dead centre is reached and the touring binding 10 then automatically snaps over into the first closed position.

As the fork-like end portion 34 is lowered, the second arm 46 of the actuating lever 36 and thus also the operating lever 50 mounted thereon rise up. The pivot pin 48 of the operating lever 50 slides in the slide 78 as far as an upper end of the slide and then likewise raises the second arm 76 of the control lever 66. The control lever 66 subsequently pivots such that the first arm 70 of the control lever 66 is lowered into the position shown in FIGS. 2*a* to 2*g*. As the first arm 70 of the control lever 66 is lowered downwards, the supporting portion 72 of the control lever 66 rises from the counter-supporting portion 74 of the limit stop element 20 and projects into a recess 86 of the limit stop element 20, such that the pivoting movement of the limit stop element 20 in the forwards direction (anticlockwise in the Figures) is now no longer limited by the supporting portion 72 of the control lever 66.

The first closed position may be a downhill position, in which the touring binding 10 is intended for downhill skiing and for example an automatic heel mechanism (not shown) holds a heel portion of the boot in fixed manner on the ski. In a downhill position, a front limit stop for positioning the boot in the X direction is not per se essentially required, such that in one variant embodiment the limit stop element 20 could already flip forwards in the first closed position. However, in the exemplary embodiment shown in the Figures, in the first closed position the supporting portion 60 of the operating lever 50 comes into contact with the limit stop element 20, in the present case with a second counter-supporting portion 88 on the front of the limit stop element 20. Thus, in the first closed position, a forwards pivoting movement of the limit stop element 20 is indeed no longer limited by the supporting portion 72 of the control lever 66, since the latter has projected into the recess 86 on the limit stop element 20, but rather by the supporting portion 60 of the operating lever 50.

If, in the first closed position, the limit stop element 20 furthermore rests on the front sole portion of the boot, this may provide the additional advantage that the lateral contact surfaces 82 may be used as a lateral support arrangement, against which a front portion of the boot may be supported to block movement of the boot in the Y direction (transversely of the longitudinal direction). If the first closed position is a downhill position of the touring binding 10, unwanted release of the touring binding 10 in the area of the toe of the boot may be prevented during downhill skiing. This need not mean that safety release of the touring binding, in particular Mz release (release of the binding on application of torque about an axis extending in the Z direction), is no longer ensured. Instead, Mz release in such a touring binding 10 may be effected in a manner known per se by a release mechanism of the automatic heel mechanism (not shown), such that the release characteristics and release thresholds may conveniently be set on just one component, namely on the automatic heel mechanism. Sports skiers in particular prefer elevated release thresholds, which sometimes cannot be achieved at all with reasonable design complexity by the release mechanism of the clamping brackets 16, i.e. the compression springs 44.

Since, as a variant embodiment of a lateral support arrangement according to the invention, the lateral contact surfaces 82 reliably prevent lateral release of the toe of the boot in the downhill position, even very high release forces may be set by appropriate automatic heel mechanisms (which may conventionally comprise substantially larger and stronger compression springs).

Retaining the limit stop element 20 in its position resting on the front sole portion of the ski boot according to FIGS. 2*a* to 2*g* when in the first closed position may furthermore result in the advantage that the user is provided with a good visual indication that the touring binding 10 has not yet been adjusted to the second closed position, which is yet to be described, in which the touring binding 10 is locked in order to avoid misrelease during climbing. In this manner and furthermore for the reason that in the first closed position pivoting of the ski boot for walking is simply not possible due to the blocked limit stop element 20, the user is reliably reminded to change the touring binding 10 over into the second closed position by a locking procedure which will be explained below with reference to FIGS. 3*a* to 3*g*.

Figure 2B:
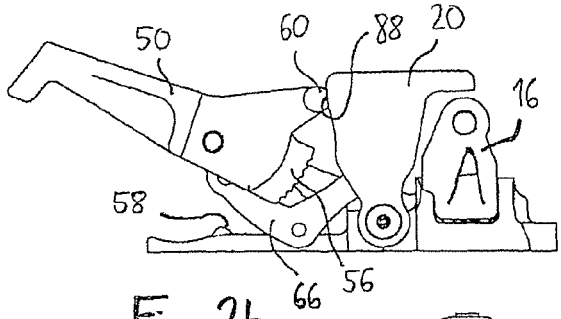
Figure 2C:
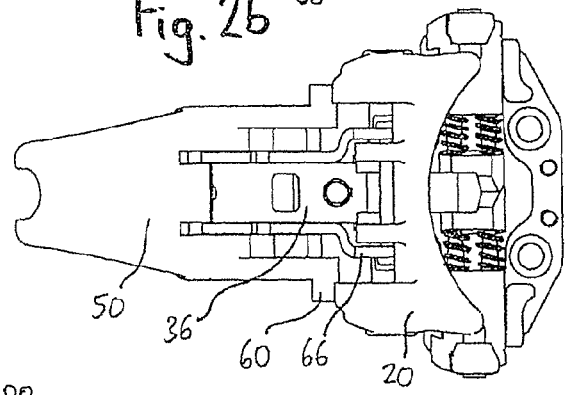
Figure 2D:
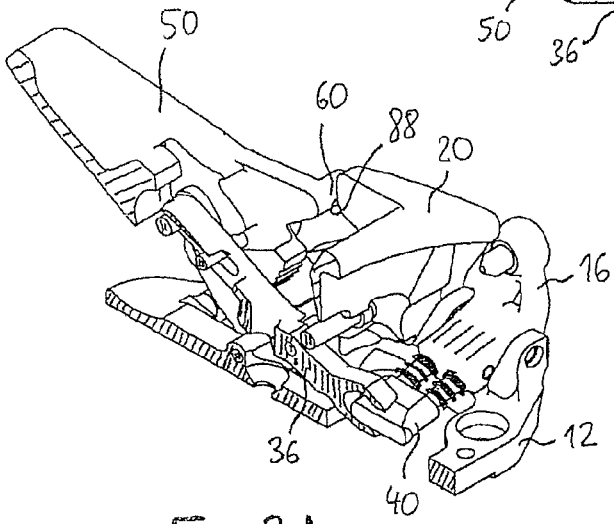
Figure 2E:
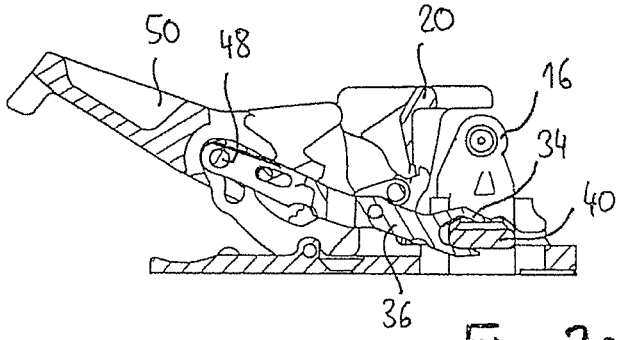
Figure 2F:
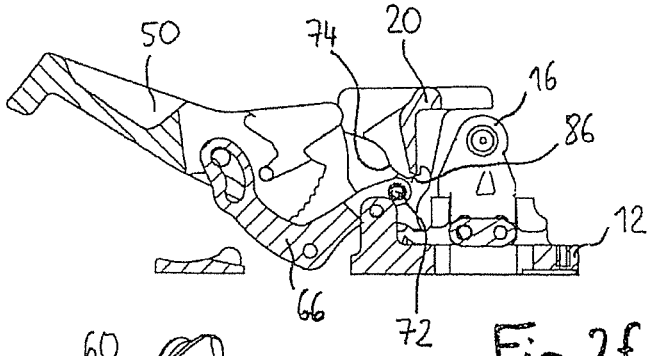
Figure 2G:
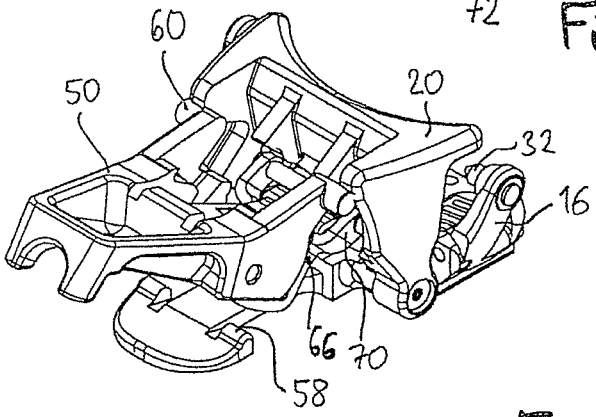
Figure 3A:
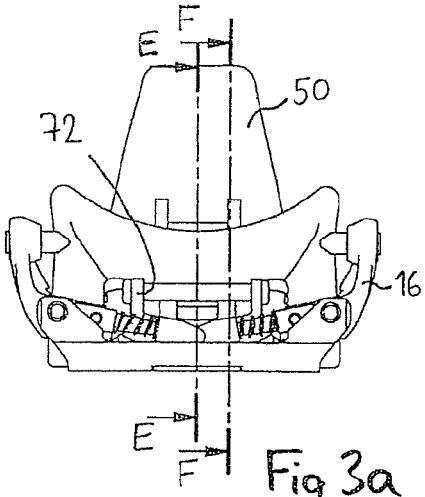
Figure 3B:
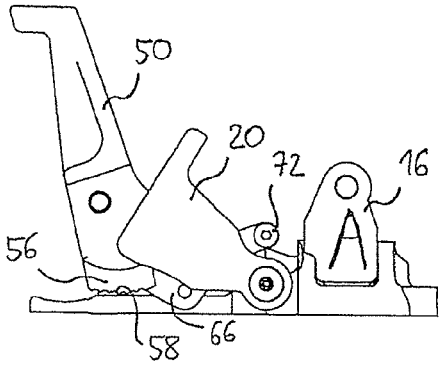
Figure 3C:
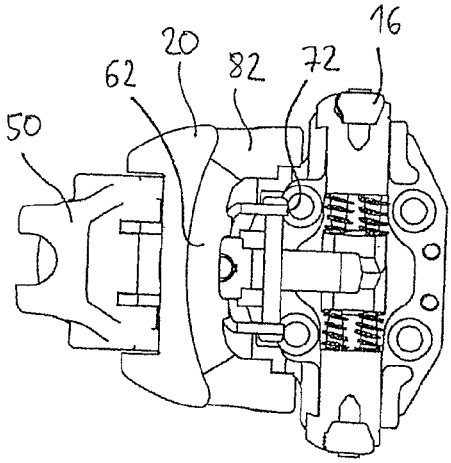
Figure 3D:
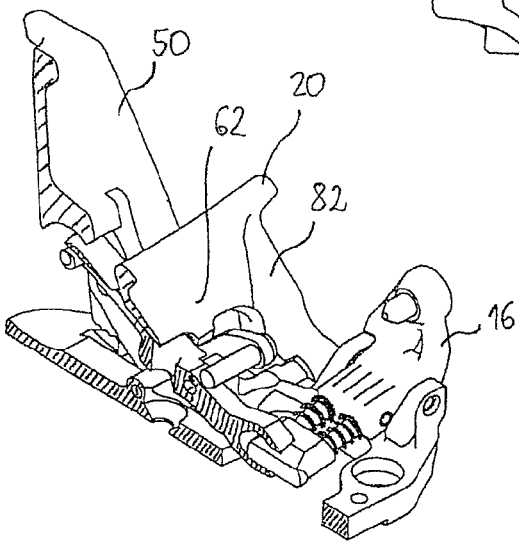
Figure 3E:
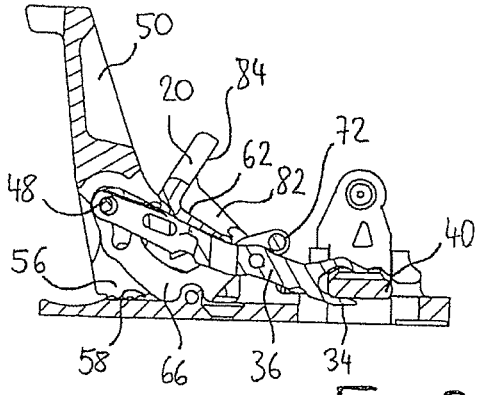
Figure 3F:
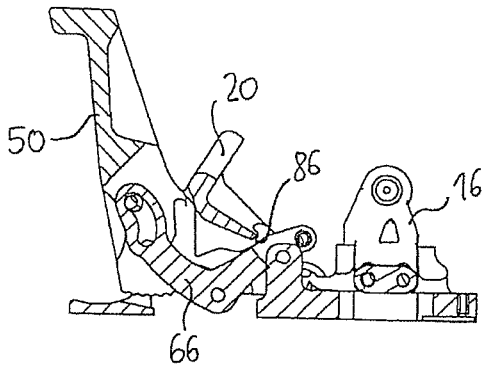
Figure 3G:
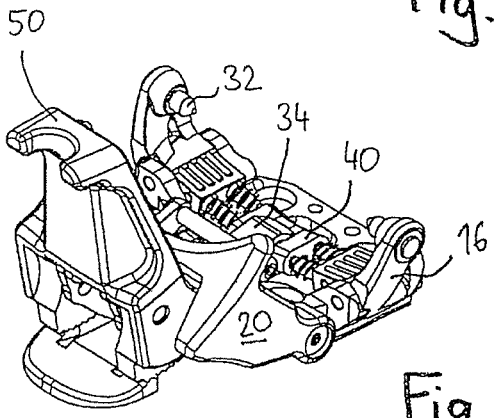

In order to adjust the touring binding 10 from the first closed position into the second closed position, the operating lever 50 is raised by its operating portion 52 and pivoted clockwise in FIGS. 2*b*, 2*e* and 2*f* until it reaches the position according to FIGS. 3*a* to 3*g*. The locking portion 56 of the operating lever 50 here slides onto the cam face 58 until the locking portion 56 is arranged approximately between the pivot pin 48 of the operating lever 50 and a portion of the cam face 58 lying substantially vertically thereunder. In the second closed position, a pivoting movement of the actuating lever 36 back into the open position is thus blocked. A force optionally additionally acting upwards in the Z direction on the pivot pin 48 during the pivoting movement of the operating lever 50 due to the cam face 58 may even pivot the actuating lever 36 slightly further towards the closed position, whereby the end caps 40 are pressed slightly further downwards and the journals 32 are pressed into particularly firm engagement with the bearing openings of the ski boot. In the second closed position, the ski boot is thus firmly locked to the touring binding 10 and unintentional release of the binding may be avoided.

In the second closed position, the positioning or support function of the limit stop element 20 is no longer necessary and the limit stop element 20 may be flipped forward out of the way, in order to enable forward pivoting of the ski boot for walking. The second closed position is then a walking position of the touring binding 10.

In the first exemplary embodiment, the limit stop element 20 may automatically flip forwards out of the way in the second closed position, since, during the pivoting movement of the operating lever 50 from the first closed position into the second closed position, the supporting portion 60 of the operating lever 50 is also pivoted away from the second counter-supporting portion 88 of the limit stop element 20 and thus no longer blocks the forwards pivoting movement of the limit stop element 20, and since furthermore the supporting portion 72 of the control lever 66 also projects into the recess 86 of the limit stop element 20. The limit stop element 20 may be flipped forward by manual actuation by the user's hand or pole, by being displaced by the forward-pivoting ski boot on the first walking step or by a previously explained spring, not shown in the drawings, which pretensions the limit stop element 20 forwards. In the latter case, flipping is automatic and thus proceeds without any additional operating effort on the part of the user.

In the second closed position shown in FIGS. 3*a* to 3*g*, the user can use the touring binding 10 in a walking position, i.e. for example an automatic heel mechanism not shown in the Figures may be set to a walking position, in which it releases a heel portion of the ski boot, such that the ski boot can pivot forwards and back again about the transverse axis Q without the limit stop element 20 preventing this movement.

The above-stated operating and functional procedures for the touring binding may proceed in reverse order when adjusting the touring binding 10 from the second closed position back into the first closed position or the open position. In particular, on pivoting of the operating lever 50 from the second closed position into the first closed position, the supporting portion 60 of the operating lever 50 moves back against the second counter-supporting portion 88 of the limit stop element 20 and raises the limit stop element 20 from its flipped forward position again until it again reaches the upright position of the first closed position, in which it is in contact with the front portion of the ski boot or is at least arranged in the immediate vicinity thereof. If the touring binding 10 is then adjusted into the open position by exerting compressive force on the operating portion 52 towards the ski, the operating lever 50, via the pivot pin 48, likewise presses the second arm 46 of the actuating lever 36 towards the ski. As a result, the pivot pin 48 slides in the slide 78 of the control lever 66 until it reaches the opposing (lower) limit stop thereof and then begins to pivot the control lever 46 anticlockwise again. The supporting portion 72 of the control lever 66 here moves back against the counter-supporting portion 74 of the limit stop element 20 and limits the pivoting movement of the limit stop element 20, while the supporting portion 60 of the operating lever 50 rises from the second counter-supporting portion 88 of the limit stop element 20. At the same time, the end caps 40 pretensioned by the compression springs 44 snap upwards over the dead centre and the clamping brackets 16 pivot outwards, such that the journals 32 release the ski boot.

A second exemplary embodiment of the present invention will be explained with reference to FIGS. 4*a* to 6*b*.

A touring binding 110 of the second exemplary embodiment comprises a base plate 112, on which are mounted two clamping brackets 116 with journals 132 for pivotably holding a ski boot 125, wherein the clamping brackets 116 may be adjusted by an actuating lever 136 between an open position, a first closed position and a second closed position. An operating lever 150, which may be used by the user for adjusting the touring binding 110, is furthermore also provided in the second exemplary embodiment. With regard to the design and function of the clamping brackets 116, the actuating lever 136 and the operating lever 150, including the locking portion 156 thereof, the second exemplary embodiment corresponds to the first exemplary embodiment, such that these details are not repeated again and explicit reference is made for this purpose to the description of the first exemplary embodiment.

In the second exemplary embodiment, the base plate 112 is not fastened directly to a surface of a ski, but is instead guided longitudinally displaceably in rails of an intermediate plate 113, which is to be fastened to the ski, and may be fixed in a specific displacement position for operation of the touring binding 110.

The touring binding 110 of the second exemplary embodiment comprises a left-hand limit stop element 120*a* and a right-hand limit stop element 120*b*. A contact portion 121*a* of the left-hand limit stop element 120*a* is designed to come into contact with a front left-hand sole portion 123 of an appropriate touring ski boot 125, while a contact portion 121*b* of the right-hand limit stop element 120*b* is designed to come into contact with a front right-hand sole portion of the touring ski boot.

The contact portions 121*a*, 121*b* may be constructed such that each contact portion respectively comprises a rear contact surface 162*a* or 162*b* and a lateral contact surface 182*a* or 182*b*. The front sole portion of the ski boot may then be supported on a relatively large surface both with regard to its position in the X direction and with regard to its position in the Y direction. The contact surfaces 162*a*, 182*a* of the left-hand limit stop element 120*a* or the contact surfaces 162*b*, 182*b* of the right-hand limit stop element 120*b* may in each case merge into one another as a continuous surface, for example as part of a curved surface adapted to the outer contour of the ski boot.

The limit stop elements 120*a*, 120*b* are in each case held pivotably on a bearing portion of the base plate 112, such that they are pivotable about a common axis 165 extending in the Y direction. In particular, they are pivotable between an upright position suitable for contact with a correctly positioned ski boot and a position in which they have been flipped forward out of the way. A left-hand coupling element 166*a* is on the one hand pivotably connected to the left-hand limit stop element 120*a* and is on the other hand pivotably connected to the operating lever 150, in particular the locking portion 156 of the operating lever 150. A right-hand coupling element 166*b* is on the one hand pivotably connected to the right-hand limit stop element 120*b* and on the other hand pivotably connected to the operating lever 150, in particular to the locking portion 156 of the operating lever 150. The pivot points of the coupling elements 166*a*, 166*b* are preferably arranged with the limit stop elements 120*a*, 120*b* on a common pin 167 extending in the Y direction and the pivot points of the coupling elements 166*a*, 166*b* with the operating lever 150 are likewise arranged on a common pin 169 extending in the Y direction.

The functioning of the touring binding 110 of the second exemplary embodiment will be explained in greater detail below. Reference is additionally explicitly made to the above description of the first exemplary embodiment.

In the open position shown in FIGS. 4*a* and 4*b*, the clamping brackets 116 are open and the actuating lever 136 is pivoted such that the operating lever 150 is as close as possible to the ski. The limit stop elements 120*a*, 120*b* are in their upright position and provide a positioning aid for the touring ski boot 125. On insertion of the boot into the touring binding 110, the user may easily find the correct position by resting a front or lateral sole portion 123 of the boot 125 on the limit stop elements 120*a*, 120*b*. The lateral bearing openings 127 of the ski boot 125 are then in a ready-to-engage position opposite the journals 132, such that, when the touring binding 110 is closed, the journals 132 may straightforwardly engage in the bearing openings 127 of the ski boot 125.

Once the clamping brackets 116 have been closed, the touring binding 110 may be in the first closed position shown in FIGS. 5*a* and 5*b*. The first closed position may be a downhill position of the touring binding 110, i.e. an automatic heel mechanism, not shown in the drawings, may retain a heel portion of the touring ski boot 125, such that the boot is firmly fixed overall to the ski. Since on changeover from the open position to the first closed position the actuating lever 136 is indeed pivoted, but the operating lever 150 is substantially not pivoted, the limit stop elements 120*a*, 120*b* remain in the upright position in contact with or at least in the immediate vicinity of the front or lateral sole portions 123 of the boot 125 and block lateral displacement (in the Y direction) of the front portion of the ski boot 125. Since the toe of the boot thus substantially can no longer be released from the touring binding 110, release behaviour may be completely brought about by appropriate setting of an automatic heel mechanism (not shown), such that release behaviour may be better defined and in particular, higher release values may also be achieved.

The touring binding 110 may be adjusted from the first closed position into the second closed position shown in FIGS. 6*a* and 6*b* by raising the operating lever 150 until the locking portion 156 is pushed approximately between the pivot pin 148 of the operating lever 150 and a portion of a cam face 158 of the base plate 112 arranged substantially perpendicularly below the pivot pin 148. Due to the pivoting movement of the operating lever 150 with regard to the actuating lever 136, the coupling elements 166*a*, 166*b* are also moved, in particular drawn forwards, such that the limit stop elements 120*a*, 120*b* flip forwards out of the way. In the exemplary embodiment, the coupling elements 166*a*, 166*b* are coupled with the locking portion 156, which, on changeover from the first closed position into the second closed position, pivots forwards such that the limit stop elements 120*a*, 120*b* are also drawn forwards.

Since, in the second closed position, the limit stop elements 120*a*, 120*b* are flipped forwards out of the way, the second closed position may be used as a walking position of the touring binding 110, in which a heel portion of the ski boot 125 is released by an automatic heel mechanism, such that the touring ski boot 125 may pivot about the axis of the journals 132. In the second closed position, this pivoting movement is no longer prevented by the limit stop elements 120*a*, 120*b*, which have been flipped forwards out of the way. While, in the second closed position, the limit stop elements 120*a*, 120*b* can also no longer assume a lateral support function, unwanted release of the touring binding 110 may, however, be prevented in the second closed position in the manner already described in relation to the first exemplary embodiment in that the locking portion 156 pushed between pivot pin 148 and cam face 158 blocks the actuating lever 136 from pivoting into the open position.

In the first and second exemplary embodiments, the rear contact surfaces 62 or 162*a*, 162*b* were constructed on the same limit stop element 20 or 120*a*, 120*b*, namely as mutually adjacent surfaces. In one particularly simple variant, combination limit stop elements could in each case be used in both exemplary embodiments, said combination limit stop elements in each case comprising a contact portion which provides both longitudinal positioning of the ski boot and lateral support of the ski boot. In particular, the limit stop elements could take the form of simple pins or projections. Due to the contour of the ski boot which tapers to a point at the front, any limit stop element arranged in this portion could in principle provide both longitudinal positioning and lateral support.

A third exemplary embodiment of the invention is described below with reference to FIGS. 7*a* to 7*d*. The touring binding 210 of the third exemplary embodiment comprises a base plate 212 for fastening to a ski, two clamping brackets 216 for pivotable mounting of an appropriate touring ski boot and a binding actuation arrangement 218 with an actuating lever 236 and an operating lever 250, in order to move the clamping brackets 216 between the open position and first or second closed position and additionally to lock the touring binding 210 in a second closed position. With regard to the design and function of the mechanisms for opening, closing and locking the clamping brackets 216 by means of the binding actuation arrangement 218, reference is explicitly made to the above description of the design and function of the first exemplary embodiment, which is identical or correspondingly constructed in this respect.

In the third exemplary embodiment, the aspect of the invention of lateral support of the touring ski boot is achieved in a particularly simple design. A left-hand limit stop element 220*a* and a right-hand limit stop element 220*b* are firmly connected to the base plate 212 and are arranged such that they are capable of coming into contact with a left-hand lateral sole portion or a right-hand lateral sole portion of an appropriate touring ski boot. The limit stop elements 220*a*, 220*b* may be constructed in one piece with the base plate 212, or fastened thereto in suitable manner.

In contrast with the first and second exemplary embodiments, the limit stop elements 220*a*, 220*b* of the third exemplary embodiment have substantially no function for positioning the ski boot in the X direction, but instead serve to support the touring ski boot in the Y direction, i.e. to prevent unwanted lateral release of a front portion of the touring ski boot. The limit stop elements 220*a*, 220*b* may accordingly be arranged in the region of the clamping brackets 216, as is shown in FIGS. 7*a* to 7*d*. In particular, the limit stop elements 220*a*, 220*b* are arranged adjacent the journal 232, but as separate elements, in order to permit movement of the clamping brackets 216 for opening and closing the touring binding 210.

In the embodiment illustrated, each of the limit stop elements 220*a*, 220*b* is arranged in a corresponding recess 217 of the associated clamping bracket 216. The recess 216 may be a through opening in the clamping bracket 216, through which the limit stop element 220*a*, 220*b* passes. The limit stop elements 220*a*, 220*b* may thus be arranged virtually in the same location as the pivotable clamping brackets 216, without preventing the pivoting movement of the clamping brackets 216. It may be seen from FIGS. 7*a* to 7*d* that in the exemplary embodiment the limit stop elements take the form of columns or pins extending upwards in one piece from the base plate 212, which pass through the passage openings 217 in the clamping brackets 216.

A contact surface 221*a* of the left-hand limit stop element 220*a* in each case facing the touring ski boot and a contact surface 221*b* of the right-hand limit stop element 220*b* facing the touring ski boot do not exactly follow the contour of the corresponding sole portion of a touring ski boot arranged in a correct position ready for skiing, but in each case comprise bevels. The bevelled contact surfaces 221*a*, 221*b* approximately correspond to the contour of a sole portion of a touring ski boot, which is pivoted towards the corresponding limit stop element 220*a* or 220*b* in such a manner that the heel of the ski boot is released from the automatic heel mechanism. The bevelled contact surfaces 221*a*, 221*b* thus permit release of the heel portion of the boot, while simultaneously reliably preventing release of the front portion of the boot from engagement with the journals 232.

It is thus also possible in the case of the touring binding 210 of the third exemplary embodiment to control release behaviour and in particular a particularly high release threshold conveniently by providing an appropriate automatic heel mechanism and appropriately setting the automatic heel mechanism, and the release behaviour of the touring binding is not limited by the release behaviour of the clamping brackets which is restricted by design factors.

Although it has been made clear with reference to the third exemplary embodiment that the aspect of lateral support of the ski boot may be achieved independently of the positioning of the ski boot in the X direction, this does not rule out the limit stop elements 220*a*, 220*b*, described for example in the third exemplary embodiment, possibly also assuming a certain positioning function for the ski boot in the X direction. In particular when the bearing openings of the ski boot are located in a front portion of the ski boot, in which the ski boot is already tapering, side support portions, which come into contact in the vicinity of the bearing openings, may simultaneously also serve as limit stops for forwards displacement of the ski boot in the X direction and thus, in the open position of the touring binding, facilitate correct positioning of the ski boot in a position ready for insertion.

The invention claimed is:

1. A touring binding, comprising two bearing portions arranged on different sides of a longitudinal axis, wherein the bearing portions, in a closed position of the touring binding, are designed to engage with opposing lateral counter-bearing portions of a boot, in order to hold the boot on the binding arrangement pivotably about a transverse axis extending transversely of the longitudinal axis, and further comprising a lateral support arrangement separate from the bearing portions, which supports a front portion of the boot in the closed position of the touring binding to block movement of the boot transversely of the longitudinal direction.

2. The touring binding according to claim 1, wherein the lateral support arrangement is fastened on a ski-mounted touring binding base member or is designed to be fastened to a ski.

3. The touring binding according to claim 1, wherein the lateral support arrangement comprises a left-hand lateral support portion for supporting a left-hand outer front lateral portion of the boot and a right-hand lateral support portion for supporting a right-hand outer front lateral portion of the boot.

4. The touring binding according to claim 1, wherein the lateral support arrangement comprises at least one limit stop surface which is adapted at least in portions to an outer contour of the boot.

5. The touring binding according to claim 1, wherein the lateral support arrangement is arranged adjacent the bearing portions.

6. The touring binding according to claim 1, wherein at least one of the bearing portions is arranged on a pivotable clamping bracket, wherein the at least one clamping bracket comprises a recess and wherein the lateral support arrangement is arranged at least in part in the recess.

7. The touring binding according to claim 1, wherein the longitudinal positioning portion comprises a limit stop, with which a front portion of the boot comes into contact in the insertion position, wherein the lateral support arrangement comprises at least one lateral support portion for supporting an outer front lateral portion of the boot, and wherein the longitudinal positioning portion and the lateral support arrangement are formed by the same limit stop arrangement, wherein the limit stop of the longitudinal positioning portion and the lateral support portion are constructed adjacent one another on a common limit stop element or are constructed as the same limit stop on a combination limit stop element.

8. A method of binding a boot to a touring binding comprising the step of:

contacting the boot with the tour binding, wherein the touring binding comprises two bearing portions arranged on different sides of a longitudinal axis, wherein the bearing portions, in a closed position of the touring binding, are designed to engage with opposing lateral counter-bearing portions of a boot, in order to hold the boot on the binding arrangement pivotably about a transverse axis extending transversely of the longitudinal axis, and further comprising a lateral support arrangement separate from the bearing portions, which may support a front portion of the boot in the closed position of the touring binding to block movement of the boot transversely of the longitudinal direction.

9. A boot and touring binding combination comprising:

a boot comprising lateral counter-bearing portions; and a touring binding comprising two bearing portions arranged on different sides of a longitudinal axis, wherein the bearing portions, in a closed position of the touring binding, are designed to engage with opposing lateral counter-bearing portions of a boot, in order to hold the boot on the binding arrangement pivotably about a transverse axis extending transversely of the longitudinal axis, and further comprising a lateral support arrangement separate from the bearing portions, which may support a front portion of the boot in the closed position of the touring binding to block movement of the boot transversely of the longitudinal direction.

* * * * *